United States Patent [19]

Haley

[11] Patent Number: 5,035,667

[45] Date of Patent: Jul. 30, 1991

[54] SWIVEL DEVICE FOR PREVENTING TWISTING OF STRINGS SUBJECTED TO TORSIONAL FORCE

[76] Inventor: Thomas F. Haley, 2701 S. Roan St., Johnson City, Tenn. 37601

[21] Appl. No.: 404,637

[22] Filed: Sep. 8, 1989

[51] Int. Cl.[5] ..... A63H 1/06

[52] U.S. Cl. ..... 446/247; 446/486; 446/250; 24/116 A

[58] Field of Search ..... 446/250, 486, 247, 258; 24/116 A

[56] References Cited

U.S. PATENT DOCUMENTS

| | | | |
|---|---|---|---|
| 1,771,125 | 7/1930 | Kahle | 24/116 A |
| 1,818,301 | 8/1931 | Canaday | 446/247 X |
| 2,563,533 | 8/1951 | Knox | 446/486 X |
| 2,639,546 | 5/1953 | Shockey | 446/258 |
| 2,773,328 | 12/1956 | Fraenkel et al. | 446/250 |
| 3,458,993 | 8/1969 | Greene | 24/116 A |

FOREIGN PATENT DOCUMENTS

| | | | |
|---|---|---|---|
| 757917 | 10/1933 | France | 446/250 |

*Primary Examiner*—Robert A. Hafer
*Assistant Examiner*—Kerry Owens
*Attorney, Agent, or Firm*—Joseph J. Zito

[57] ABSTRACT

A device for eliminating the twisting and accompanying stress associated with yo-yo strings during operation by providing for rotation of the string about its central elongate axis without rotation of the yo-yo. The device of the present invention is inserted in-line between the yo-yo and the operator grip. The device includes two segments attached by a pivotal axis concentric with the string central axis. The string is divided into two segments, a device-yo-yo segment and a device-operator segment.

4 Claims, 1 Drawing Sheet

SWIVEL DEVICE FOR PREVENTING TWISTING OF STRINGS SUBJECTED TO TORSIONAL FORCE

BACKGROUND OF THE INVENTION

The present invention relates to the prevention of the twisting of the control string of a cyclical returning toy commonly referred to as a yo-yo. More specifically, the present invention relates to an in-line device providing a pivotal joint for the prevention of the build up of torsional force in the yo-yo string.

During operation of a yo-yo, which primarily spins about its central axis, it is common for the yo-yo to exhibit a rotational motion about a secondary axis coincident with the longitudinal axis of the extended portion of the control string of the yo-yo. This secondary motion imparts a torsional force on the yo-yo control string, resulting in an undesirable twisting of the string, which can lead to inoperability of the yo-yo and constriction of the operational finger of the operator.

SUMMARY OF THE INVENTION

It is an object of the present invention to provide a device for the prevention of twisting of the control string of a yo-yo, through dissipation of the torsional force.

It is another object of the present invention to provide an in-line device for a yo-yo string which dissipates torsional force imparted on the string to prevent the twisting of the string.

It is a further object of the present invention to provide an in-line device which prevents twisting of the control string and allows for normal operation of the yo-yo.

It is yet another object of the present invention to provide a device which can be retrofit to the existing string of a yo-yo to prevent twisting of such string.

These and further objects as will become apparent from the following detailed description, are accomplished by provision of a device in accordance with the teachings hererin, wherein a first portion of the device is attached to a first string segment attached to the yo-yo and a second portion of the device is attached to a second string segment held by the operator of the yo-yo, the two portions of the device being pivotally interconnected.

DESCRIPTION OF THE PREFERRED EMBODIMENTS

Figure 1:
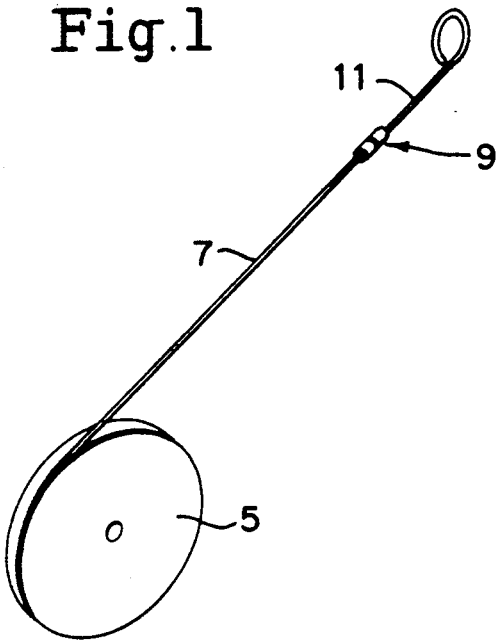
FIG. 1 is a perspective view of the present invention operationally connected to a yo-yo.

As illustrated in FIG. 1, the control string of the yo-yo 5 is divided into two segments, a first segment 7 connected between the device of the present invention 9 and the yo-yo 5, and a second segment 11 connected to the device 9 and forming a loop for the yo-yo operator (not illustrated).

Figure 2:
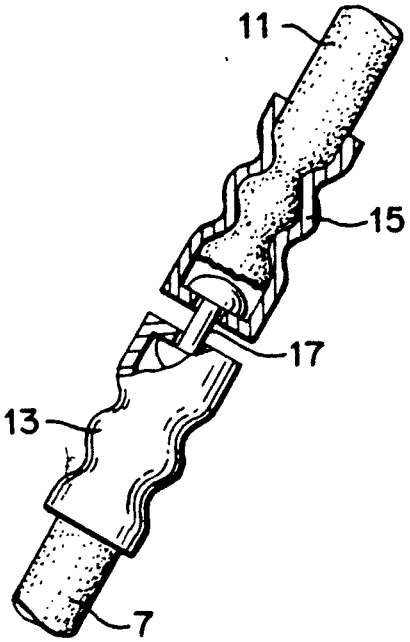
FIG. 2 is a partial cross-sectional and partial cutaway detail view of a first embodiment of the present invention.

In a first embodiment of the invention, as illustrated in FIG. 2, the first segment 7 is connected to a first portion 13 of the device 9, and the second segment 11 is connected to a second portion 15. The string is held by crimping of the portions as illustrated by the deformity of each portion. The string can be secured by other suitable means such as gluing or tying.

As illustrated, the crimping members 13 and 15 surround the respective string portions and are provided with a wide opening at one end for receipt of the string and with a smaller opening at the opposite end. A connecting shaft member 17 is provided which extends through the smaller openings in the opposing faces of the portions 13 and 15 to provide a pivotal joint. This joint allows for unimpeded rotation about the central elongate axis of the string.

Figure 3:
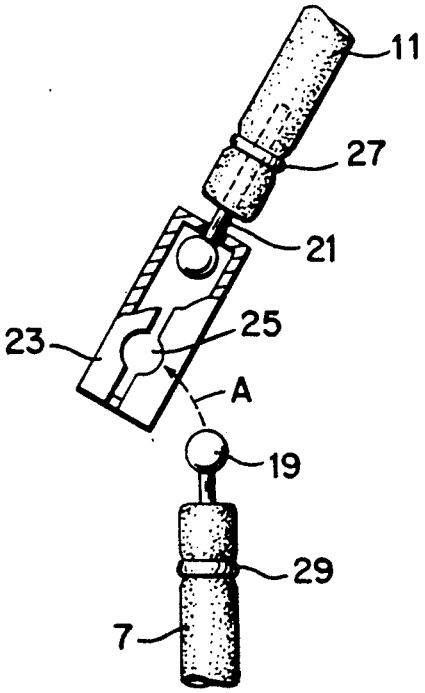
FIG. 3 is a partial cross-sectional and partial assembly view of a second embodiment of the present invention.

FIG. 3 illustrates a second embodiment for providing a swivel joint in accordance with the teachings of the present invention. String segments 7 and 11 are attached to the shaft portion of ball and shaft linking members 19 and 21 respectively. A central connector 23 is provided to receive the ball portions of members 19 and 21. Member 21 is illustrated as pivotally seated within connector 23. Arrow A illustrates the manner in which the ball portion of member 19 is seated. The ball portion passes through hole 25 in connector 23 as the shaft portion is accommodated by the attached slot.

As illustrated in FIG. 3, the string segments 7 and 11 are attached to linking members 19 and 21 by insertion of the shafts of the linking members into the exposed free ends of the string segments. The cut exposed free ends of string segments 7 and 11 present a frayed end, as is common with standard material such as that used to make string. The shaft portions of linking members 19 and 21, being of smalle diameter than the string segments can be easily inserted within the string strands. Restricting elements 27 and 29 are then applied to the exterior of the string segments to clamp the string around the shafts and to retain the linking members 19 and 21 attached to the string segments 7 and 11.

It will be understood that the above description of the present invention is susceptible to various modifications, changes and adaptations, and the same are intended to be comprehended within the meaning and range of equivalents of the appended claims.

What is claimed is:

1. A swivel device for preventing twisting of a yo-yo string for placement between a first segment of the yo-yo string attached to the yo-yo and a second segment of the yo-yo string provided with an operator grip, comprising:

shaft means for forming a pivotal axis concentric with the elongate central axis of said string segments;

first gripping means including a hollow cylindrical portion, a first opening at a first end of said cylindrical portion for receipt of a first one of said string segments, and a second opening at a second end of said cylindrical portion for receipt of a first end of said shaft means and including an annular ledge encircling said respective second opening, said cylindrical portion having deformable walls for compressional engagement of said string segment upon inward deformation after receipt of said segment; and second gripping means including a hollow cylindrical portion, a first opening at a first end of said cylindrical portion for receipt of a second one of said string segments, and a second opening at a second end of said cylindrical portion for receipt of a first second end of said shaft means and including an annular ledge encircling said respective second opening, said cylindrical portion having deformable walls for compressional engagement of said string segment upon inward deformation after receipt of said segment;

said shaft means including first and second head portions for abuttingly engaging said annular ledges of said first and second gripping means respectively.

2. A swivel device for preventing twisting of a yo-yo string for placement between a first segment of the yo-yo string attached to the yo-yo and a second segment of the yo-yo string provided with an operator grip, comprising:

shaft means for forming a pivotal axis concentric with the elongate central axis of said string segments;

first gripping means including a hollow cylindrical portion, a first opening at a first end of said cylindrical portion for receipt of a first one of said string segments, a second opening at a second end of said cylindrical portion for receipt of a first end of said shaft means and including an annular ledge encircling said respective second opening, and retaining means for attaching said first string segment within said cylindrical portion, and;

second gripping means including a hollow cylindrical portion, a first opening at a first end of said cylindrical portion for receipt of a second one of said string segments, a second opening at a second end of said cylindrical portion for receipt of a second end of said shaft means and including an annular ledge encircling said respective second opening, and retaining means for attaching said second string segment within said cylindrical portion;

said shaft means including first and second head portions for abuttingly engaging said annular ledges of said first and second gripping means respectively.

3. A swivel device for preventing twisting of a yo-yo string for placement between a first segment of the yo-yo string attached to the yo-yo and a second segment of the yo-yo string provided with an operator grip, comprising:

shaft means for forming a pivotal axis concentric with the elongate central axis of said string segments;

first gripping means including a hollow cylindrical portion, a first opening at a first end of said cylindrical portion for receipt of a first one of said string segments, and a second opening at a second end of said cylindrical portion for receipt of a first end of said shaft means and including an annular ledge encircling said respective second opening, second gripping means including a hollow cylindrical portion, a first opening at a first end of said cylindrical portion for receipt of a second one of said string segments, and a second opening at a second end of said cylindrical portion for receipt of a second end of said shaft means and including an annular ledge encircling said respective second opening, and means for securing said first and second string segments within said cylindrical portions of said first and second gripping means;

said shaft means including first and second head portions for abuttingly engaging said annular ledges of said first and second gripping means respectively.

4. The swivel device of claim 3, wherein said securing means includes a contact adhesive.

* * * * *